US008607568B2

(12) United States Patent
Zuo et al.

(10) Patent No.: US 8,607,568 B2
(45) Date of Patent: Dec. 17, 2013

(54) DRY LOW NOX COMBUSTION SYSTEM WITH PRE-MIXED DIRECT-INJECTION SECONDARY FUEL NOZZLE

(75) Inventors: Baifang Zuo, Simpsonville, SC (US); Thomas Johnson, Greer, SC (US); Willy Ziminsky, Simpsonville, SC (US); Abdul Khan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 952 days.

(21) Appl. No.: 12/465,805

(22) Filed: May 14, 2009

(65) Prior Publication Data

US 2010/0287942 A1 Nov. 18, 2010

(51) Int. Cl.
*F02C 1/00* (2006.01)

(52) U.S. Cl.
USPC ..... 60/737; 60/740; 60/746

(58) Field of Classification Search
USPC ..... 60/737, 738, 746, 747, 752, 804
See application file for complete search history.

(56) References Cited

U.S. PATENT DOCUMENTS

| | | | | |
|---|---|---|---|---|
| 4,100,733 | A * | 7/1978 | Striebel et al. | 60/39.463 |
| 4,292,801 | A * | 10/1981 | Wilkes et al. | 60/776 |
| 4,845,952 | A * | 7/1989 | Beebe | 60/737 |
| 4,982,570 | A | 1/1991 | Waslo et al. | |
| 5,125,227 | A * | 6/1992 | Ford et al. | 60/39.23 |
| 5,193,346 | A | 3/1993 | Kuwata et al. | |
| 5,235,814 | A | 8/1993 | Leonard | |
| 5,253,478 | A * | 10/1993 | Thibault et al. | 60/733 |
| 5,259,184 | A | 11/1993 | Borkowicz et al. | |
| 5,410,884 | A * | 5/1995 | Fukue et al. | 60/267 |
| 5,487,275 | A * | 1/1996 | Borkowicz et al. | 60/747 |
| 5,794,449 | A * | 8/1998 | Razdan et al. | 60/737 |
| 6,192,688 | B1 | 2/2001 | Beebe | |
| 6,427,446 | B1 * | 8/2002 | Kraft et al. | 60/737 |
| 6,813,890 | B2 * | 11/2004 | Martling et al. | 60/737 |
| 6,983,600 | B1 * | 1/2006 | Dinu et al. | 60/737 |
| 7,024,861 | B2 * | 4/2006 | Martling | 60/737 |
| 7,093,438 | B2 * | 8/2006 | Dinu et al. | 60/737 |
| 7,509,808 | B2 * | 3/2009 | Storey et al. | 60/740 |
| 2006/0096294 | A1 * | 5/2006 | Farhangi et al. | 60/776 |

FOREIGN PATENT DOCUMENTS

| | | | |
|---|---|---|---|
| CN | 1675500 | A | 9/2005 |
| CN | 101392917 | A | 3/2009 |
| EP | 1975513 | A2 | 10/2008 |

OTHER PUBLICATIONS

Office Action for Chinese Application No. 201010146860.8 dated Sep. 4, 2013.

* cited by examiner

*Primary Examiner* — Phutthiwat Wongwian
*Assistant Examiner* — Michael B Mantyla
(74) *Attorney, Agent, or Firm* — Sutherland Asbill & Brennan LLP

(57) ABSTRACT

A combustion system includes a first combustion chamber and a second combustion chamber. The second combustion chamber is positioned downstream of the first combustion chamber. The combustion system also includes a pre-mixed, direct-injection secondary fuel nozzle. The pre-mixed, direct-injection secondary fuel nozzle extends through the first combustion chamber into the second combustion chamber.

13 Claims, 4 Drawing Sheets

DRY LOW NOX COMBUSTION SYSTEM WITH PRE-MIXED DIRECT-INJECTION SECONDARY FUEL NOZZLE

STATEMENT REGARDING FEDERALLY SPONSORED RESEARCH OR DEVELOPMENT

This invention was made with government support under DE-FC26-05NT42643 awarded by the Department of Energy. The Government has certain rights in this invention.

TECHNICAL FIELD

The present disclosure generally relates to a dry low NOx combustion system that includes a secondary fuel nozzle, and more particularly relates to a two-stage dry low NOx combustion system that includes a pre-mixed, direct-injection secondary fuel nozzle.

BACKGROUND OF THE INVENTION

A gas turbine generally includes a compressor, a combustion system, and a turbine section. Within the combustion system, air and fuel are combusted to generate a heated gas. The heated gas is then expanded in the turbine section to drive a load.

Historically, combustion systems employed diffusion combustors. In a diffusion combustor, fuel is diffused directly into the combustor where it mixes with air and is burned. Although efficient, diffusion combustors are operated at high peak temperatures, which creates relatively high levels of pollutants such as nitrous oxide (NOx).

To reduce the level of NOx resulting from the combustion process, dry low NOx combustion systems have been developed. These combustion systems use lean pre-mixed combustion, which pre-mixes air and fuel to create a relatively uniform air-fuel mixture before directing the mixture into the combustion zone. The mixture is then combusted at relatively lower temperatures, generating relatively lower levels of NOx.

One combustor suited for lean, pre-mixed combustion is a two-stage combustor of the type disclosed in U.S. Pat. No. 4,292,801, entitled "Dual Stage-Dual Mode Low NOx combustor." Such a combustor includes two combustion chambers positioned adjacent to each other. One of the combustion chambers is in communication with a number of primary fuel nozzles, while a second combustion chamber is in communication with a secondary fuel nozzle. The distinct nozzles permit introducing air and fuel into the combustion chambers in staged modes. In a pre-mixing mode, for example, a lean mixture of air and fuel is created in the first combustion chamber, which is then combusted in the second combustion chamber at a relatively lower, controlled peak temperature, reducing NOx production.

Although such combustion systems achieve lower levels of NOx emissions, the fuel nozzles may be relatively likely to experience undesirable flame conditions, such as flashback or auto-ignition. Flashback denotes the upstream propagation of a flame from an expected location in the combustion chamber into the fuel nozzle, while auto-ignition denotes the unexpected ignition of the air-fuel mixture directly in the fuel nozzle itself. Regardless of the source of the flame, the fuel nozzle may tend to "hold" the flame, which may damage the fuel nozzle or other portions of the gas turbine. To address this problem, combustion systems are normally designed to reduce the occurrence of auto-ignition, flashback and flame-holding.

Recently, alternatives fuels have been investigated for use with gas turbines, which may improve efficiency, lower pollutant emissions, or both. For example, synthesis gases ("syngas") are alternative fuels derived from sources such as coal. These and other alternative fuels may have a relatively high hydrogen content, which may be relatively reactive. The reactivity of such fuels improves the efficiency of the combustor, but exacerbates the risk for undesirable flame events such as flashback, auto-ignition, and flame holding.

Flame events may be particularly likely to occur in the secondary fuel nozzle of a two-stage combustion system. Because the secondary nozzle is not suited for use with syngas and other high reactivity fuels, the fuel flexibility of the system is limited.

From the above, it is apparent that a need exists for a dry low NOx combustion system that includes a secondary fuel nozzle suited for use with alternative fuels.

BRIEF DESCRIPTION OF THE INVENTION

A combustion system includes a first combustion chamber and a second combustion chamber. The second combustion chamber is positioned downstream of the first combustion chamber. The combustion system also includes a pre-mixed, direct-injection secondary fuel nozzle. The pre-mixed, direct-injection secondary fuel nozzle extends through the first combustion chamber into the second combustion chamber.

Other systems, devices, methods, features, and advantages of the disclosed systems and methods will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION OF THE INVENTION

Figure 1:
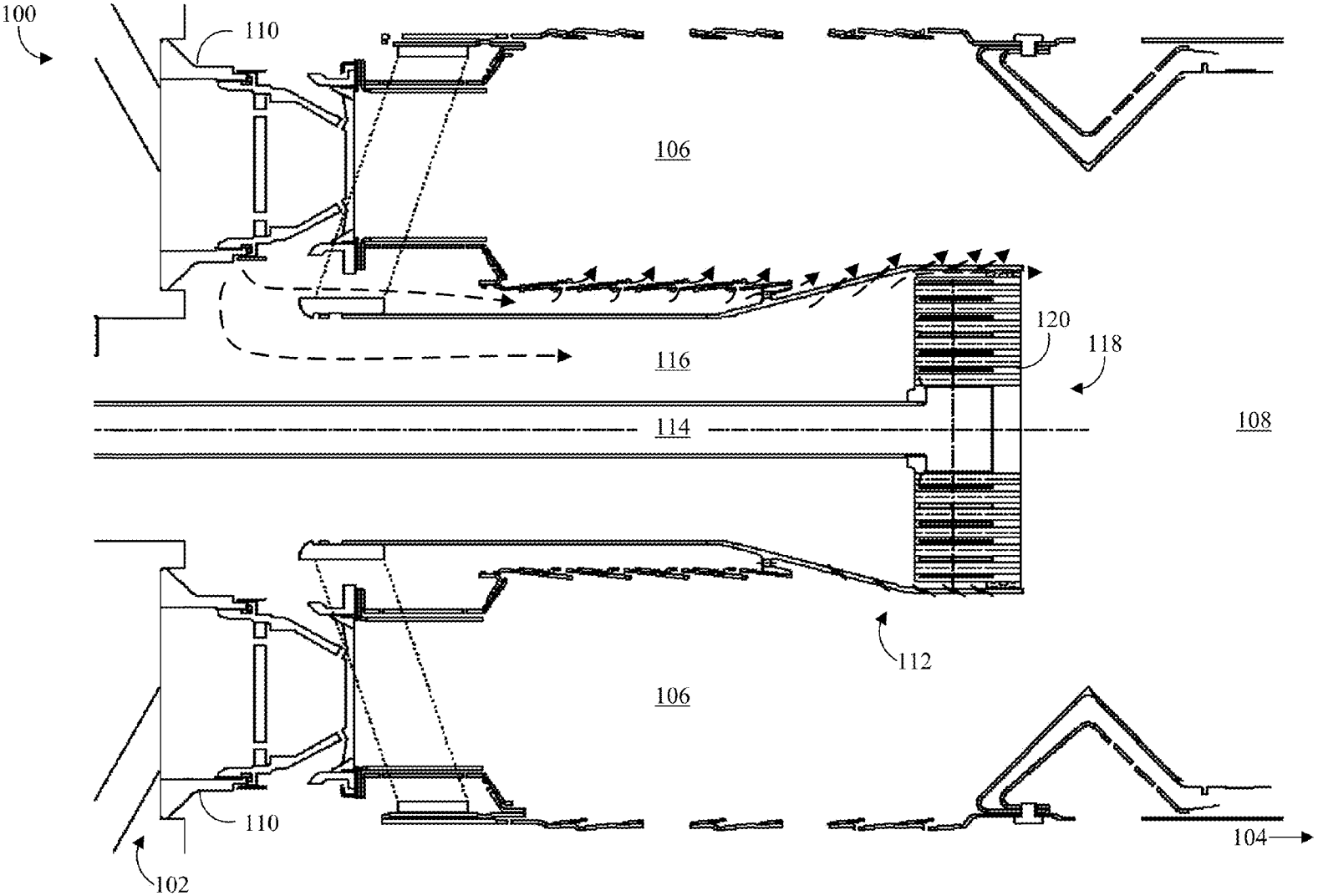
FIG. 1 is a partial cross-sectional view of a two-stage combustor.

FIG. 1 is a partial cross-sectional view of an embodiment of a two-stage combustor 100 of a gas turbine. Within the gas turbine, the combustor 100 may be positioned downstream of a compressor and upstream of a turbine section. Typically, the gas turbine includes a number of combustors 100 arranged in a circular array about the gas turbine, although only one combustor 100 is shown in FIG. 1. In operation, the compressor may provide compressed air to the combustor 100. The combustor 100 may combust the compressed air with fuel to create a heated gas. The heated gas may be expanded in the turbine section to drive a load, and in some cases, the compressor. Thereby, energy may be extracted from fuel to produce useful work.

As shown, the combustor 100 may be a two-stage combustor configured to create relatively low levels of nitrogen oxide (NOx) during the combustion process. Additionally, the combustor 100 may be equipped with a pre-mixed direct-injection (PDI) secondary fuel nozzle, which may reduce the risk of flame conditions such as flashback, auto-ignition, or flame-holding. Thus, the combustor 100 may be operated with a wider ranger of fuels, including synthesis fuels, high hydrogen fuels, or other reactive fuels, such as fuels that include carbon monoxide, ethane, or propane, mixtures of reactive fuels, or combinations thereof.

As mentioned above, an upstream end 102 of the combustor 100 may be in communication with the compressor and a downstream end 104 of the combustor 100 may be in communication with the turbine section. Between the upstream and downstream ends 102, 104, the combustor 100 may include two combustion chambers. The chambers may be positioned adjacent to each other, with a primary combustion chamber 106 relatively closer to the upstream end 102 and a secondary combustion chamber 108 relatively closer to the downstream end 104.

The combustor 100 may also include a number of fuel nozzles. The fuel nozzles may extend through an end cap that encloses the combustor 100 on the upstream end 102. A number of primary fuel nozzles 110 may extend through the end cap into the primary combustion chamber 106, and a secondary fuel nozzle 112 may extend through the end cap into the secondary combustion chamber 108. As is known, the fuel nozzles 110, 112 may communicate air and fuel into the chambers 106, 108 from the compressor and a fuel supply, respectively.

The primary fuel nozzles 110 may have a range of configurations known in the art. For example, the primary fuel nozzles 110 may be premixing nozzles, or "swozzles", which create a swirling flow. Because such nozzles are known, further description is omitted here. The secondary fuel nozzle 112 may be pre-mixed direct-injection ("PDI") fuel nozzle.

As shown, the PDI secondary fuel nozzle 112 generally includes a fuel passage 114, an air passage 116, and a mixing head 118. The fuel and air passages 114, 116 may be positioned to communicate fuel and air into the mixing head 118. The mixing head 118 may include a number of mixing tubes 120. The air and fuel may be mixed in the mixing tubes 120 to create an air-fuel mixture, which may be injected into the secondary combustion chamber 108.

When the PDI secondary fuel nozzle 112 is associated with the combustor 110, the fuel and air passages 114, 116 may communicate air and fuel through the end cap. The fuel passage 114 may be associated with a source of conventional fuel, such as methane, or alternative fuel, such as syngas. The air passage 116 may be in communication with the compressor. For example, the air passage 116 may be positioned to receive air through an annular flow sleeve positioned about the combustor 100, as known in the art. The mixing head 118 may positioned downstream of the fuel and air passages 114, 116, adjacent to the secondary combustion chamber 108 of the combustor 100. With this arrangement, fuel and air may flow through the fuel and air passages 114, 116 into the mixing tubes 120, where the fuel and air may mix to form the air-fuel mixture for combustion in the secondary combustion chamber 108.

The PDI secondary fuel nozzle 112 is described in further detail with reference to FIG. 2, which is a partial cross-sectional view of an embodiment the nozzle 112, and FIG. 3, which is a perspective, partial cut-away view of the same embodiment. As shown, the mixing head 118 of the nozzle 112 may include between about seventy-five to about one hundred and fifty mixing tubes 120, although any number of mixing tubes 120 may be used. The mixing tubes 120 may be a "bundle" of tubes aligned substantially parallel to each other. Each of the mixing tubes 120 may include an inlet portion, an intermediate portion, and an outlet portion. The inlet portion defines an inlet 122 that is in communication with the air passage 116. The outlet portion defines an outlet 124 that is in communication with the secondary combustion chamber 108 of the combustor 100. The intermediate portion includes one or more fuel injection holes 126 in communication with the fuel passage 114, so that fuel may be injected into the mixing tube 120 for mixing with the air. The mixing tubes 120 may be arranged to form an angle with a surface of the combustor cap, so that a swirling flow may be established downstream of the nozzle 112 in the secondary combustion chamber 108.

As shown in the illustrated embodiment, the fuel and air passages 114, 116 may be segregated from each other to prevent mixing of the fuel and air upstream of the mixing tubes 120. For example, an outer wall 128 may define a boundary of the air passage 116 and an inner wall 130 may define a boundary of the fuel passage 114. The walls 128, 130 may be substantially cylindrical, for example. The walls 128, 130 also may be concentrically disposed, such the fuel passage 114 extends through the air passage 116 toward the mixing head 118 (or the reverse).

Figure 3:
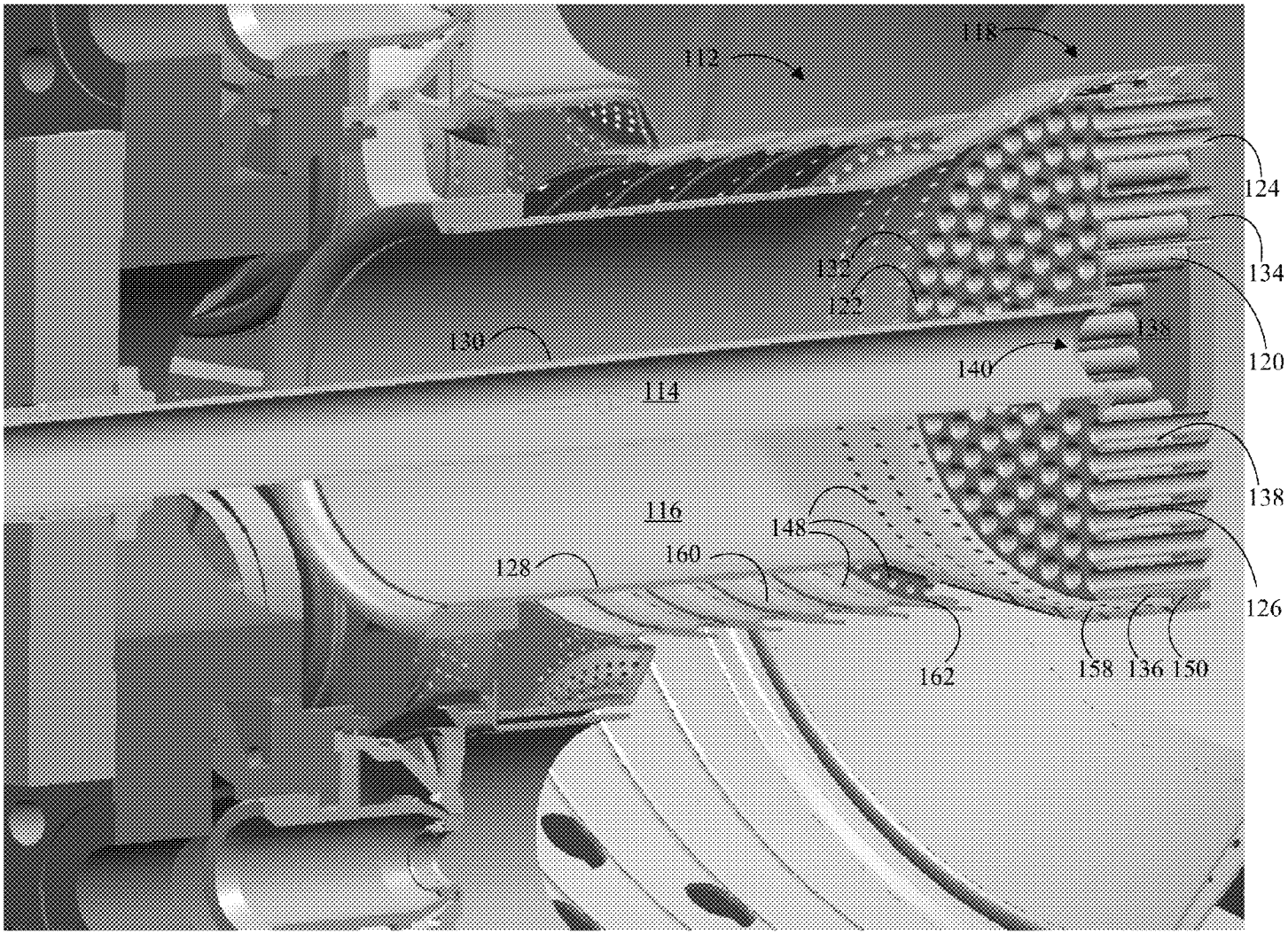
FIG. 3 is a partial, cut-away perspective view of the embodiment of the pre-mixed direct-injection secondary fuel nozzle shown in FIG. 2.

As shown in FIG. 3, the mixing head 118 may be substantially enclosed by an upstream face 132, a downstream face 134, and a lateral face 136. The upstream and downstream faces 132, 134 may be substantially planar surfaces, while the lateral face 136 may be, for example, substantially cylindrical. The inlets and outlet 122, 124 of the mixing tubes 120 may be formed through the upstream and downstream faces 132, 134 of the mixing head 118, respectively. The mixing tubes 120 may register with these inlets and outlets 122, 124, extending through the mixing head 118 from the upstream face 132 to the downstream face 134.

A fuel plenum 138 may be defined on an interior of the mixing head 118 between the faces 132, 134 of the mixing head 118 and exterior surfaces of the mixing tubes 120. The fuel plenum 138 may be in communication with the fuel passage 114. For example, an opening 140 may be formed in the upstream face 132 of the mixing head 118, and the fuel passage 114 may terminate at the opening 140 so that fuel may be directed into the fuel plenum 138. The fuel plenum 138 also may be in communication with the fuel injection holes 126 of the mixing tubes 120, so that fuel may be directed from the fuel plenum 138 into the fuel injection holes 126. The fuel exiting the fuel passage 114 may impinge on inside surfaces of the mixing head 118, providing high heat transfer coefficients. In embodiments in which the fuel passage 114 is centrally located, such as the illustrated embodiment, the fuel may expand radially outward through the fuel plenum 138 and into the fuel injection holes 126. Other configurations are possible.

With this arrangement, air flows through the air passage 116, through the inlets 122, and into the mixing tubes 120. Simultaneously, fuel flows through the fuel passage 114, into the fuel plenum 138, about the exterior surfaces of the mixing tubes 120 and into the fuel injection holes 126. The air and fuel mix in the mixing tubes 120 to form the air-fuel mixture, which exits the mixing tubes 120 at the outlets 124. The air-fuel mixture passes from the outlets 124 into an ignition zone in the secondary combustion chamber 108, where the mixture is combusted to form a heated gas for expansion in the turbine.

In normal operation, the combustion flame resides in the ignition zone of the secondary combustion chamber 108. However, the use of alternative fuels such as syngas or other high reactivity fuels, including fuels that include hydrogen, carbon monoxide, ethane, or propane, or mixtures of such fuels, may exacerbate the risk for auto-ignition, flashback and flame holding, which may result in flame burning in the secondary fuel nozzle. To reduce or eliminate this risk, the PDI secondary fuel nozzle 112 is designed so that in the event of flame held in the mixing tube 120, the heat release inside the mixing tube 120 from the held flame would be less than the heat loss to the wall of the mixing tube 120. This criterion limits the tube size, fuel jet penetration, and fuel jet recession distance. In principal, a longer recession distance yields better mixing of the fuel and air. If the ratio of a recession distance R of the fuel injection hole 126 (described below) to an inner tube diameter $D_L$ of the mixing tube 120 is relatively high, meaning the fuel mixes relatively uniformly with the air before entering the secondary combustion chamber 108, a relatively lower NOx output may result during combustion but the nozzle 112 may be susceptible to flashback and flame holding within the individual mixing tubes 120. The flame may damage the individual mixing tubes 120, which may require replacement.

Accordingly, the relatively small mixing tubes 120 mix the fuel and air relatively quickly to a ratio that produces reduces pollutant emissions in the secondary combustion chamber 108 while reducing the risk of flame in the mixing tubes 120. The configuration of the mixing tubes 120 permits burning high-hydrogen or syngas fuel with relatively low NOx, without significant risk of unintended flame in the nozzle 112.

Figure 4:
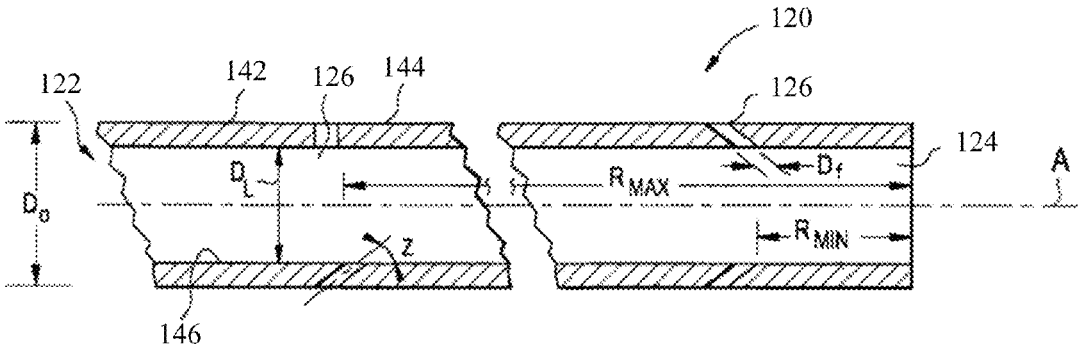
FIG. 4 is a partial, cross-sectional view of an embodiment of a mixing tube that may be used with the pre-mixed direct-injection secondary fuel nozzle shown in FIG. 2.

An example mixing tube 120 is shown in FIG. 4, which is a partial cross-sectional view. The mixing tube 120 may include an outer tube wall 142 extending axially along a tube axis A from the inlet 122 to the outlet 124. The outer tube wall 142 may have an outer circumferential surface 144 and an inner circumferential surface 146. The outer circumferential surface 144 may have an outer tube diameter $D_o$, while the inner circumferential surface 146 may have an inner tube diameter $D_L$. As shown, a number of fuel injection holes 126 may extend between the outer circumferential surface 144 and the inner circumferential surface 146 of the outer tube wall 142, each fuel injection hole 126 having a fuel injection hole diameter $D_f$. In embodiments, the fuel injection hole diameter $D_f$ may be less than or equal to about 0.03 inches. Also in embodiments, the inner tube diameter $D_L$ may be about four to about twelve times greater than the fuel injection hole diameter $D_f$.

The fuel injection holes 126 may be angled through the outer wall 142 of the mixing tube 120. More specifically, each fuel injection hole 126 may form an injection angle Z with reference to a vector extending along the tube axis A toward the outlet 124. The fuel injection holes 126 also may be a located upstream of the outlet 124 by a recession distance R. The recession distance R may permit the fuel and air to at least partially mix within the mixing tube 120 before entering the secondary combustion chamber 108. The recession distance R may be relatively short, but the number and size of the fuel injection holes 126, along with the injection angle Z, may be selected to achieve relatively fast mixing of the fuel in air. Thus, relatively low NOx emissions may occur when the resulting mixture is combusted, such as NOx emissions on the scale of less than about 9 ppm. The injection angle Z may be selected to reduce jet-cross-flow wake domain and to increase fuel and air mixing. When the jet-cross-flow wake domain is reduced or substantially eliminated, local flame holding may not occur. The stretched partial diffusion flame sheet may be lifted due to flamelet extinction. If the recession distance R is less than the flame lift-off height, flame will station out of the nozzle. Because the recession distance R may be relatively short, the tube length may be relatively short. Thus, a pressure drop across the mixing tube 120 may be within an acceptable range.

The injection angle Z may be in the range of about twenty degrees to about ninety degrees. In embodiments suited for use with certain high-hydrogen fuels, the injection angle Z may be optimized to achieve emissions with reasonable flame holding margin. Compound injection angle may also be used to generate extra swirling flow, which may enhance air fuel mixing.

The recession distance R generally may range between a minimum recession distance $R_{min}$ that is about five times greater than the fuel injection hole diameter $D_f$ and a maximum recession distance $R_{max}$ that is one hundred times greater than the fuel injection hole diameter $D_f$. As mentioned above, the fuel injection hole diameter $D_f$ generally may be equal to or less than about 0.03 inches. In embodiments, the recession distance R may be equal to or less than about 1.5 inches and the inner tube diameter $D_L$ may be between about 0.05 inches and about 0.3 inches. Such embodiments of mixing tubes may be designed for use with fuels such as high-hydrogen fuels or syngas. Such embodiments may achieve acceptable mixing and target NOx emission. Some fuels such as high-hydrogen fuels or syngas may work better with mixing tubes 120 having an inner tube diameter $D_L$ of about 0.15 inches. In embodiments, the recession distance R may be generally proportional to the burner tube velocity, the tube wall heat transfer coefficient, and the fuel blow-off time. The recession distance R also may be inversely proportional to the cross flow jet height, the turbulent burning velocity, and the pressure.

In embodiments suited for use with relatively higher reactivity fuels, the mixing tubes 120 may have a length between about one and about three inches. Each mixing tube 120 may have between about one and about eight fuel injection holes 126, each having a fuel injection hole diameter $D_f$ that may be less than or equal to about 0.03 inches. For example, each mixing tube 120 may have between about four and about six fuel injection holes 126, each having a fuel injection hole diameter $D_f$ that may be between about 0.01 inches and about 0.03 inches. In embodiments suited for use with lower reactivity fuels such as natural gas, the mixing tubes 120 may have a length of about one foot. Each mixing tube may have about two to about eight fuel injection holes 126 suited for a low pressure drop. In these and other embodiments, the fuel injection holes 126 may have injection angles Z between about 10 degrees and about 90 degrees.

A number of different combinations of the above configurations may be used to design different nozzles or incorporate them within the same nozzle to achieve the desired mixing of fuel and air and to achieve the target NOx emissions, or dynamics etc. For example, the mixing tubes 120 may include a number of fuel injection holes 126 at varying recession distances R. These fuel injection holes 126 may have different injection angles Z that vary as a function of, for example, the recession distance R, the diameter $D_f$ of the fuel injection holes 126, or a combination thereof. These and other parameters may be varied to obtain adequate mixing while reducing the length of the mixing tube 120, so that a pressure drop between the inlet 122 and the outlet 124 is not unreasonably high. For example, a relatively low pressure drop, such as a pressure drop of less than about 5%, may be achieved between the inlet 122 and the outlet 124.

The parameters above also may be varied based on factors such as the composition of the fuel, the temperature of the fuel, the temperature of the air, the pressure upstream or downstream of the mixing tubes 120, the pressure drop across the mixing tubes 120, and the nature of any treatment applied to the inner and outer circumferential surfaces 144, 146 of the outer tube walls 142 of the mixing tubes 120. Performance may be enhanced if the inner circumferential surface 146 of the mixing tube is smooth, as the air and fuel mixture flows across this surface. For example, the inner circumferential surface 146 may be honed smooth.

In embodiments, the mixing tubes 120 may be further configured based on location within the mixing head 118. In the illustrated embodiment, for example, mixing tubes 120 positioned on a periphery of the mixing head 118 may receive relatively less air flow than mixing tubes 120 positioned near a center of the mixing head 118. Thus, the size, number, and location of fuel injection holes 142 may be further selected to vary the fuel flow to the mixing tubes 120 depending on location in the mixing head 118. For example, the mixing tubes 120 positioned about the periphery of the mixing head 118 may receive relatively less fuel than the mixing tubes positioned near the center of the mixing head 118.

With reference back to FIG. 2, the PDI secondary fuel nozzle 112 may be cooled to prevent damage to its exterior surface, which may be exposed within the primary combustion chamber 106 to relatively high temperatures, and at times a combustion flame. The PDI secondary fuel nozzle 112 generally may be cooled along its length, such as via film cooling, and the mixing head 118 may be cooled about its downstream face 134, such as by a swirling flow. For example, a number of cooling holes 148 may be formed along a length of the PDI secondary fuel nozzle 112, which may permit cooling air to escape about the exterior surface of the nozzle. Additionally, a number of swirling vanes 150 may be positioned about a downstream end of the PDI secondary fuel nozzle 112, which may direct a swirling air flow about the downstream face 134 of the nozzle 112.

Figure 2:
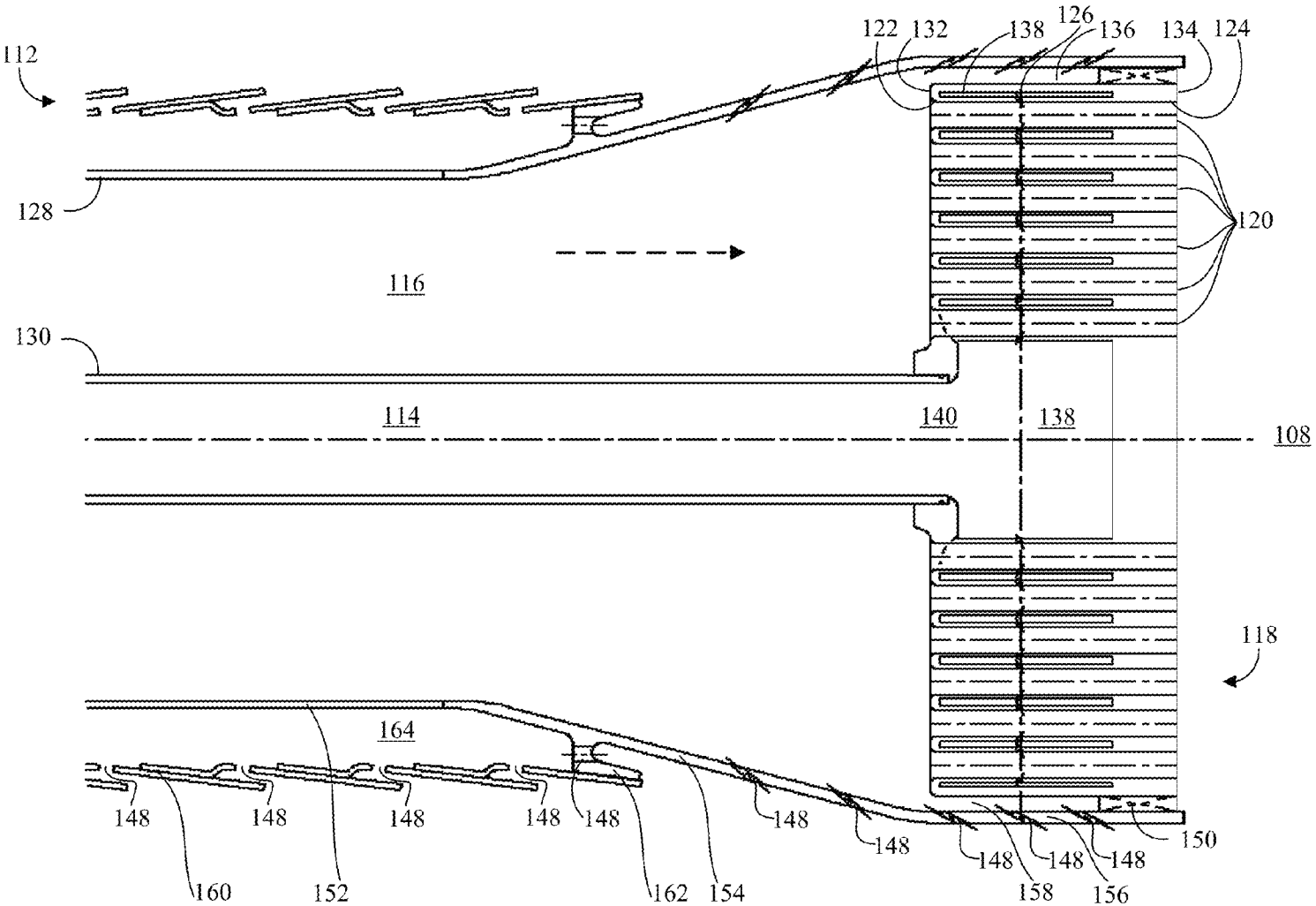
FIG. 2 is a partial cross-sectional view of an embodiment of a pre-mixed direct-injection secondary fuel nozzle for use with a two-stage combustor.

With reference to FIG. 2, in embodiments the outer wall 128 may have an upstream portion 152 that defines the air passage 116 into the mixing head 118. Along the upstream portion 152, the outer wall 128 may have a relatively uniform cross-sectional area. Moving downstream, the outer wall 128 may taper outward along a tapered portion 154 of increasing cross-sectional area. The outward taper along the tapered portion 154 permits accommodating the relatively larger mixing head 118 within a downstream portion 156 of the outer wall 128. Along the downstream portion 156, the outer wall 128 may return to a relatively uniform cross-sectional area of slightly larger diameter than the mixing head 118, so that a gap 158 is formed between the outer wall 128 and the lateral face 136 of the mixing head 118.

For cooling purposes, a louvered wall 160 may be positioned about the upstream portion of the outer wall 128. In embodiments, the louvered wall 160 may include a number of louver panels. The louvered wall 160 may terminate at a joint 162, which may join to the outer wall 128 along the tapered portion 154. The cooling holes 148 may be formed through the louvered wall 160, through the joint 162, through the tapered portion 154 of the outer wall 128, and through the downstream portion 156 of the outer wall 128.

The louvered wall 160 may be spaced apart from the outer wall 128 to form a cooling air channel 164. The cooling air channel 164 may be in communication with the compressor to receive air. For example, air from the compressor may pass from an annular flow sleeve positioned about the combustor into the cooling air channel 164. Air from the same source may pass into the air passage 116 through the nozzle 112. Air flowing through the cooling air channel 164 may escape through the cooling holes 148 in the louvered wall 160. The louvered wall 160 may direct the escaping air downstream, forming a film of cooling air about the exterior of the nozzle 112. Air flowing through the cooling air channel 164 also may escape through the cooling holes 148 in the joint 162 that joins the louvered and outer walls 160, 128, cooling the joint 162. On the interior of the nozzle 112, air flowing through the air passage 116 may escape through the cooling holes 148 along the tapered and downstream portions 154, 156 of the outer wall 128. Thus, an exterior of the PDI secondary fuel nozzle 112 may be protected by a film of cooling air, which may protect the nozzle from thermal damage, such as when the combustor 100 is operated in diffusion mode.

The air flowing through the air passage 116 may also travel along the gap 158 between the outer wall 128 and the lateral face 136 of the mixing head 118. A series of swirling vanes 160 may extend from the lateral face 136 of the mixing head 118, adjacent to the downstream face 134. For example, the swirling vanes 160 may have a forty degree swirling angle. The swirling vanes 150 may swirl the air traveling through the gap 158. The swirling flow may be directed into the secondary combustion chamber 108 about the downstream face 134 of the mixing head 118. The swirling flow may cool the mixing head 118, such as in the area of the gap 158. The swirling flow may facilitate stabilizing the combustion flame within the secondary combustion chamber 108, reducing the likelihood of flashback into the primary combustion chamber 106 where a combustible mixture exists. The reduced cross-sectional area in the throat region connecting the primary and secondary combustion chambers 106, 108 may further reduce the likelihood of flashback, as is known in the art.

In embodiments, the PDI secondary fuel nozzle 112 may be cooled in a comparable manner to a conventional secondary fuel nozzle. Thus, the structural environment of the combustion chambers 106, 108 may be relatively comparable to the structural environment of convention combustion chambers suited for use with a conventional secondary fuel nozzle 112. Such a configuration may permit retrofitting an existing combustor with a PDI secondary fuel nozzle 112 without substantially redesigning the combustor.

Embodiments of a PDI secondary fuel nozzle described above permit operating a two-stage combustor with conventional fuels, such as methane, or alternative fuels, including high-hydrogen fuels and syngas. Such fuels may be injected into the secondary combustion chamber using the PDI secondary fuel nozzle, without substantially increasing the risk of auto-ignition, flashback, or flame holding. The PDI secondary fuel nozzle may be adequately cooled to prevent damage in the presence of high temperatures and flame in the primary combustion chamber. Such cooling may be accomplished in a manner that obviates substantially redesigning the combustor to accommodate the PDI secondary fuel nozzle structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

At least the following is claimed:

1. A combustion system comprising:

a first combustion chamber;

a second combustion chamber positioned downstream of the first combustion chamber; and a pre-mixed, direct-injection secondary fuel nozzle extending through the first combustion chamber into the second combustion chamber, the pre-mixed, direct-injection secondary fuel nozzle, comprising:

a mixing head comprising a plurality of mixing tubes;

a first wall defining a fuel passage into the mixing tubes;

a second wall positioned outward of the first wall wherein the first wall and the second wall define a combustion air passage into the mixing tubes, wherein the second wall comprises an upstream portion having a first diameter, a downstream portion having a second diameter that is larger than the first diameter, and a tapered portion having an increasing diameter from the upstream portion to the downstream portion, and wherein the downstream portion of the second wall surrounds the mixing head and is spaced apart from the mixing head to form a gap therebetween;

a third wall positioned outward of the second wall, wherein the second wall and the third wall define a cooling air passage, wherein the third wall comprises a plurality of louvers and a plurality of apertures, and wherein the third wall is positioned about the upstream portion of the second wall and at least partially about the tapered portion of the second wall upstream of the mixing head; and a plurality of swirling vanes positioned in the gap between the mixing head and the second wall;

a joint located at a downstream end of the third wall that joins the third wall to the tapered portion of the second wall upstream of the mixing head; and a plurality of cooling holes formed through the joint.

2. The combustion system 1, wherein each mixing tube comprises at least one fuel injection hole.

3. The combustion system of claim 2, wherein the at least one fuel injection hole is recessed from an outlet of the mixing tube by a recession distance.

4. The combustion system of claim 1, wherein the pre-mixed, direct-injection secondary fuel nozzle comprises:

each mixing tube comprising an inlet and at least one fuel injection hole;

the combustion air passage being in communication with the inlets; and the fuel passage being in communication with the fuel injection holes.

5. The combustion system of claim 4, wherein each mixing tube further comprises an outlet in communication with the second combustion chamber.

6. The combustion system of claim 4, further comprising a fuel plenum positioned about the mixing tubes, the fuel plenum communicating with the fuel passage and the fuel injection holes.

7. The combustion system of claim 4, wherein the combustion air passage extends about the mixing head to cool the mixing head.

8. The combustion system of claim 7, further comprising a plurality of cooling holes formed in the combustion air passage about the mixing head.

9. A pre-mixed direct-injection secondary fuel nozzle, comprising:

a mixing head comprising a plurality of mixing tubes;

a first wall defining a fuel passage into the mixing tubes;

a second wall positioned outward of the first wall, wherein the first wall and the second wall define a combustion air passage into the mixing tubes, wherein the second wall comprises an upstream portion having a first diameter, a downstream portion having a second diameter that is larger than the first diameter and a tapered portion having an increasing diameter from the upstream portion to the downstream portion, and wherein the downstream portion of the second wall surrounds the mixing head and is spaced apart from the mixing head to form a gap therebetween;

a third wall positioned outward of the second wall, wherein the second wall and the third wall define a cooling air passage, wherein the third wall comprises a plurality of louvers and a plurality of apertures, and wherein the third wall is positioned about the upstream portion of the second wall and at least partially about the tapered portion of the second wall upstream of the mixing head; and a plurality of swirling vanes are positioned in the gap between the mixing head and the second wall;

a joint located at a downstream end of the third wall that joins the third wall to the tapered portion of the second wall upstream of the mixing head; and a plurality of cooling holes formed through the joint.

10. The pre-mixed direct-injection secondary fuel nozzle of claim 9, wherein a plurality of cooling holes are formed through the second wall about the mixing head.

11. The pre-mixed direct-injection secondary fuel nozzle of claim 9, wherein each of the mixing tubes comprises:

an inlet in communication with the air passage;

an outlet;

a plurality of fuel injection holes in communication with the fuel passage, each fuel injection hole being recessed from the outlet.

12. The pre-mixed direct-injection secondary fuel nozzle of claim 9, wherein:

the third wall is concentrically disposed about the second wall; and the second wall is concentrically disposed about the first wall.

13. A combustion system comprising:

a first combustion chamber;

a second combustion chamber positioned downstream of the first combustion chamber; and a pre-mixed, direct-injection secondary fuel nozzle extending through the first combustion chamber into the second combustion chamber, the pre-mixed, direct-injection secondary fuel nozzle, comprising:

a mixing head comprising a plurality of mixing tubes;

a first wall defining a fuel passage into the mixing tubes;

a second wall positioned outward of the first wall, wherein the first wall and the second wall define a combustion air passage into the mixing tubes, wherein the second wall has an upstream portion having a first diameter, a downstream portion having a second diameter that is larger than the first diameter, and a tapered portion having an increasing diameter from the upstream portion to the downstream portion, wherein the downstream portion of the second wall surrounds the mixing head and is spaced apart from the mixing head to form a gap therebetween;

a third wall positioned outward of the second wall, wherein the second wall and the third wall define a cooling air passage, wherein the third wall comprises a plurality of louvers and a plurality of apertures, wherein the third wall is positioned about the upstream portion of the second wall and ends about the tapered portion of the second wall;

a joint positioned at a downstream end of the third wall on the tapered portion of the second wall upstream of the mixing head, wherein the joint is configured to join the third wall to the tapered portion of the second wall upstream of the mixing head;

a plurality of cooling holes formed through the joint; and a plurality of swirling vanes positioned in the gap between the mixing head and the second wall.

* * * * *